US006494451B2

(12) United States Patent
Michel

(10) Patent No.: US 6,494,451 B2
(45) Date of Patent: Dec. 17, 2002

(54) ANTI-SKEW IDLER ROLLER SYSTEM

(75) Inventor: Teodoro Ortiz Michel, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 141 days.

(21) Appl. No.: 09/814,295

(22) Filed: Mar. 19, 2001

(65) Prior Publication Data

US 2002/0130463 A1 Sep. 19, 2002

(51) Int. Cl.[7] ..... B65H 5/04; G03G 15/00; B65G 15/08; B65G 21/16; F16C 25/04

(52) U.S. Cl. ..... 271/274; 101/DIG. 35; 399/395; 198/824; 384/202

(58) Field of Search ..... 271/272, 224; 101/DIG. 35; 399/395; 198/824; 384/202

(56) References Cited

U.S. PATENT DOCUMENTS 4,346,883 A * 8/1982 Speraggi ..... 226/185
4,478,402 A * 10/1984 Kane ..... 271/100
5,069,442 A * 12/1991 Storz ..... 271/250

* cited by examiner

*Primary Examiner*—Donald P. Walsh
*Assistant Examiner*—Kenneth W. Bower

(57) ABSTRACT

An idler roller assembly in an imaging system including a sheet material transport roller system having drive rollers and idler rollers. The idler roller assembly includes a plurality of idler rollers. A plurality of springs are connected to apply respective normal forces to the idler rollers. Pivoting linkages are provided to equalize the normal forces applied to the respective rollers by respective springs. In an embodiment, the plurality of idler rollers includes a first idler roller and a second idler roller. The plurality of springs includes a first spring connected to apply a normal force to the first idler roller and a second spring connected to apply a normal force to the second idler roller. The pivoting linkage includes a first pivoting lever member connected between the first spring and the second spring.

20 Claims, 2 Drawing Sheets

ANTI-SKEW IDLER ROLLER SYSTEM

FIELD OF THE INVENTION

The present invention relates to drive mechanisms for sheet material feed arrangements. Specifically, the invention relates to improved antiskew roller assemblies for sheet material feed rollers suitable for use in imaging systems.

BACKGROUND OF THE INVENTION

Imaging systems such as printers, fax machines, and copiers are virtually omnipresent, and can be found in homes and offices worldwide. The development of such systems has facilitated improvements in communication that have in turn fostered a sea change in the way people live and work. Telecommuting, paperless offices, and intra-office networks represent but a few examples of the advancements that have been made possible by modern imaging systems.

Since these systems have become crucial to everyday existence, their reliability and smooth operation is paramount. It is therefore vitally important to design imaging systems so that downtime and work interruptions are minimized. This can be a daunting challenge, given the relative complexity of systems in which sheet material must be infed, moved through the imaging process, and outfed in a matter of seconds.

One common and recurring problem in imaging systems is document misfeed, which can result in sheet material such as paper getting lodged in the transport mechanism. This condition, often referred to as a "jam", is a source of frustration for system users.

One cause of such jams is "skew", or misalignment of sheet material being transported through the imaging system. Skew can also cause other problems, such as marks on the sheet material and job misalignment.

The phenomenon of skew is illustrated in FIGS. 1 and 2. A sheet of material M, such as paper or transparency material, is transported through an imaging system by a set of transport rollers R. All points on the sheet M are moving at the same speed in the translational direction of the arrow A. As shown in FIG. 2, the rollers R are exerting uneven forces on the sheet M, causing a rotational movement is the direction of the arrow A'.

The causes of skew are best understood in the context of a typical idler roller arrangement, illustrated in FIGS. 3 and 4. A plurality of traction rollers T are mounted on a drive axle D. A corresponding plurality of idler rollers I are mounted in roller frames F. The roller frames F are pivotally mounted on a pivot axle P. The idler rollers I are urged against the traction rollers T by a plurality of springs S1 through S4, which are mounted on a rigid spring bar B.

The amount of spring strain produced by the springs S1 through S4 determines the amount of normal force applied to the traction rollers T by the idler rollers I. Since sheet material passes between the traction rollers T and the idler rollers I as it is transported through the imaging system, these normal forces also determine the amount and uniformity of translational movement applied to the sheet material. These forces are a function of the effective spring rates of the springs S1 through S4, which are determined by a variety of factors, for example, the mechanical properties and deformation of the individual springs, manufacturing processes used to produce the springs, and even the configuration of the roller frames and other housing geometry. If any of these factors differs from spring to spring, the normal forces exerted by the springs will be non-uniform. This condition frequently causes the rolling resistance on the sheet material to be greater on one side of the of the sheet than the other. The difference in rolling resistance imparts a rotational component to the movement of sheet material, thus causing skew.

It can thus be seen that the need exists for a simple, inexpensive mechanism to reduce the likelihood of skewing in sheet material transport systems.

SUMMARY OF THE INVENTION

These and other objects are achieved by providing an idler roller assembly in an imaging system including a sheet material transport roller system having drive rollers and idler rollers. The idler roller assembly includes a plurality of idler rollers. A plurality of springs are connected to apply respective normal forces to the idler rollers. Pivoting linkages are provided to equalize the normal forces applied to the respective rollers by respective springs.

In an embodiment, the plurality of idler rollers includes a first idler roller and a second idler roller. The plurality of springs includes a first spring connected to apply a normal force to the first idler roller and a second spring connected to apply a normal force to the second idler roller. The pivoting linkage includes a first pivoting lever member connected between the first spring and the second spring.

The first pivoting lever member can include a first end connected to the first spring member, and a second end connected to the second spring member. A fulcrum point is located between the first end and the second end of the first pivoting lever member.

The idler roller assembly can also be provided with a first spring bracket connecting the first end of the first pivoting lever member to the first spring member. A second spring bracket connects the second end of the first pivoting lever member to the second spring member.

The plurality of idler rollers can include a first idler roller, a second idler roller, a third idler roller, and a fourth idler roller. In such an embodiment, the plurality of springs includes a first spring connected to apply a normal force to the first idler roller, a second spring connected to apply a normal force to the second idler roller, a third spring connected to apply a normal force to the third idler roller, and a fourth spring connected to apply a normal force to the fourth idler roller. The pivoting linkage then includes a first pivoting lever member connected between the first spring and the second spring, a second pivoting lever member connected between the third spring and the fourth spring, and a third pivoting lever member connected between the first pivoting lever member and the second pivoting lever member.

The first pivoting lever member can include a first end connected to the first spring member, and a second end connected to the second spring member. A fulcrum point is located between the first end and the second end of the first pivoting lever member.

The second pivoting lever member includes a first end connected to the third spring member, and a second end connected to the fourth spring member. A fulcrum point is located between the first end and the second end of the second pivoting lever member.

The third pivoting lever member includes a first end connected to the fulcrum of the first pivoting lever member, and a second end connected to the fulcrum of the second pivoting lever member. A fulcrum point is located between the first end and the second end of the third pivoting lever member.

A method of reducing skew in sheet material transported by a roller system is also set forth. The method is described in the context of an imaging system including a sheet material transport roller system having at least one pair of drive rollers and at least one pair of corresponding idler rollers. In a first step, a respective spring is connected to each of the idler rollers in the at least one pair of idler rollers to apply respective normal forces to the idler rollers. A pivoting link is connected between the springs and the at least one pair of idler rollers to equalize the normal forces applied to the respective rollers by respective springs.

The features of the invention believed to be patentable are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE INVENTION

Figure 1:
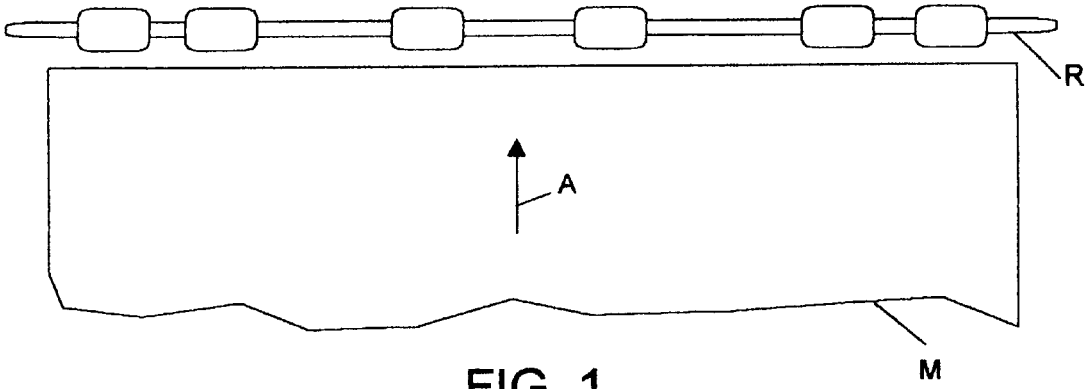
FIG. 1 (BACKGROUND ART)
FIGS. 1 through 4 illustrate background art, as described in the Background of the Invention.
Figure 2:
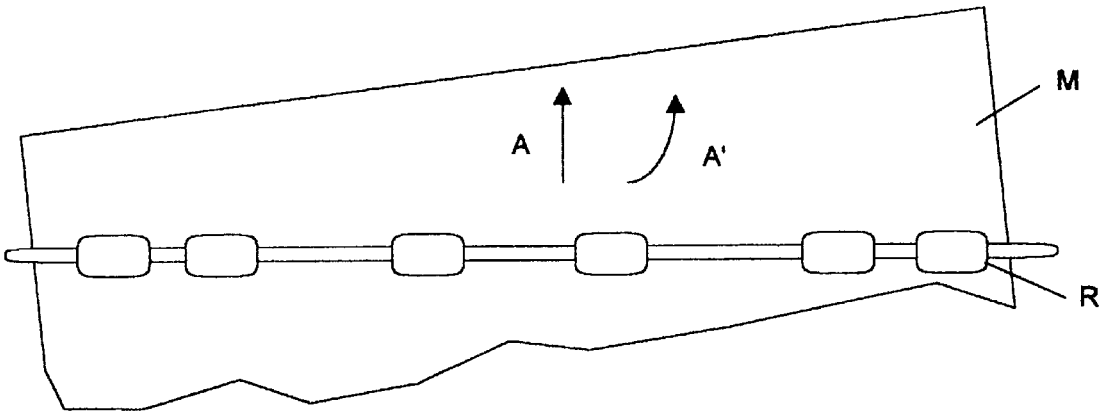
FIG. 2 (BACKGROUND ART)
Figure 3:
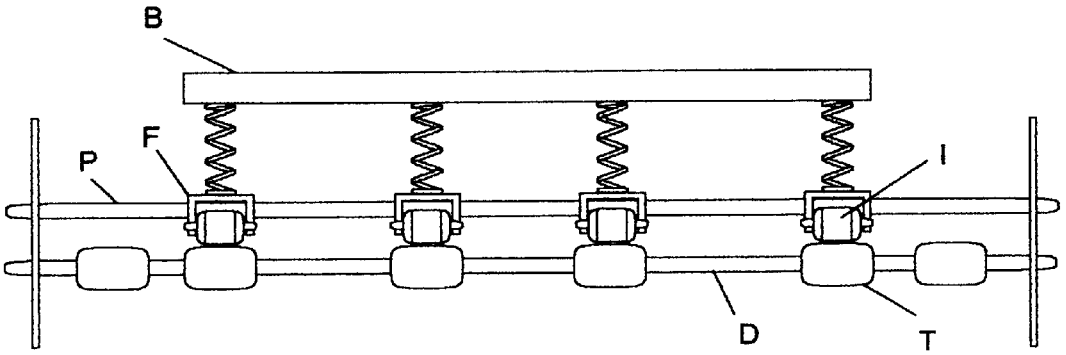
FIG. 3 (BACKGROUND ART)
Figure 4:
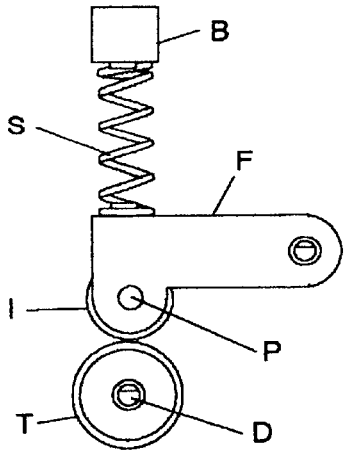
FIG. 4 (BACKGROUND ART)
Figure 5:
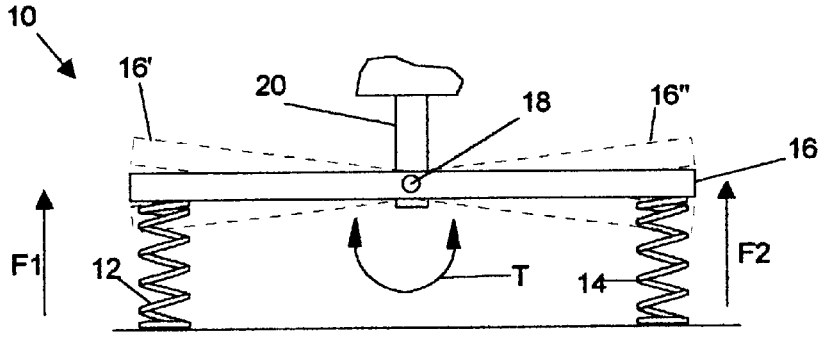
FIG. 5 is a schematic illustration of a force equalization mechanism.

The present invention employs the principles of a pivoting linkage system 10, as shown in FIG. 5. A first spring 12 having a spring rate of K1, and a second spring 14 having a spring rate K2. The springs 12, 14 are mounted at opposite ends of a pivoting lever member 16. The lever member 16 pivots about a fulcrum point 18, which is secured to a stable mounting member 20. The lever member 16 pivots to equalize the normal forces applied by respective springs 12, 14, as demonstrated in the following three examples.

In the first example, when the factors affecting effective spring rate are such that K1 is equal to K2, the lever member 16 will be in the position shown in solid line in FIG. 5. In this position, both springs have the same strain and spring rate, and the torque T about the fulcrum point 18 of the lever member 16 is zero.

In the second example, when the factors affecting effective spring rate are such that K1 is greater than K2, the result is a non-zero torque T about the fulcrum point 18 of the lever member 16. In order for the system to arrive at equilibrium, the left side of the lever member 16 rotates to the position shown in broken line at 16' in FIG. 5. In equilibrium, the spring forces are equal and the torque T returns to zero.

Similarly, in the third example, when the factors affecting effective spring rate are such that K1 is less than K2, the result is a non-zero torque T about the fulcrum point 18 of the lever member 16. In order for the system to arrive at equilibrium, the right side of the lever member 16 rotates to the position shown in broken line at 16" in FIG. 5. In equilibrium, the spring forces are equal and the torque T returns to zero.

Figure 6:
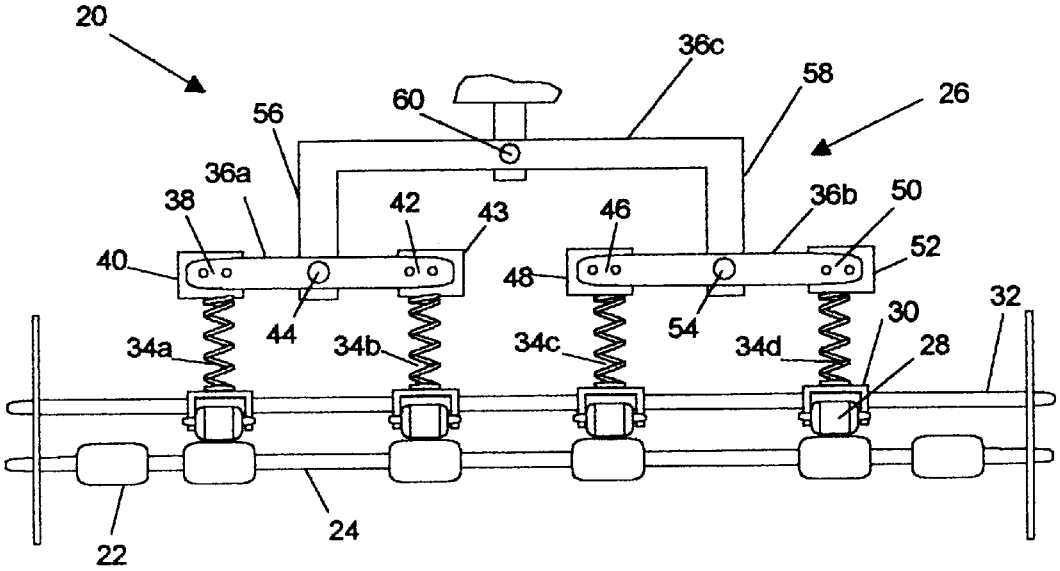
FIG. 6 is a schematic illustration of a roller system in accordance with the principles discussed herein.

FIG. 6 illustrates a roller system 20 in which the principles described with reference to FIG. 5 are applied. The roller system 20 includes a plurality of traction rollers 22 mounted on a drive axle 24. The roller assembly 22 also includes an idler roller assembly 26. The idler roller assembly 26 includes a plurality of idler rollers 28 corresponding in number and location to the traction rollers 22. As is conventional, the idler rollers 28 are mounted in respective roller frames 30, which are pivotally mounted on a pivot axle 32. A plurality of springs 34*a*, 34*b*, 34*c*, and 34*d* are connected to apply respective normal forces to the idler rollers 28. Pivoting linkages 36*a*, 36*b*, and 36*c* are provided to equalize the normal forces applied to the respective rollers 28 by respective springs 34*a*, 34*b*, 34*c*, and 34*d*.

The pivoting lever member 36*a* includes first end 38 connected to the spring member 34*a* by a spring bracket 40, and a second end 42 connected to the spring member 34*a* by a spring bracket 43. A fulcrum point 44 is located between the first end 38 and the second end 42 of the pivoting lever member 36*a*.

The pivoting lever member 36*b* includes first end 46 connected to the spring member 34*c* by a spring bracket 48, and a second end 50 connected to the spring member 34*d* by a spring bracket 52. A fulcrum point 54 is located between the first end 48 and the second end 50 of the pivoting lever member 36*b*.

The pivoting lever member 36*c* includes a first end 56 connected to the fulcrum 44 of the pivoting lever member 36*a*, and a second end 58 connected to the fulcrum 54 of the pivoting lever member 36*b*. A fulcrum point 60 is located between the first end 56 and the second end 58 of the pivoting lever member 36*c*.

In the FIG. 6 embodiment, when the factors affecting effective spring rates of the respective springs 34*a*, 34*b*, 34*c*, and 34*d* are unequal, the pivoting linkages 36*a*, 36*b*, and 36*c* can rotate to compensate. This brings the idler roller assembly 26 to an equilibrium position, wherein the spring forces are equal and the overall torque returns to zero. Thus, the normal force exerted by the springs 34*a*, 34*b*, 34*c*, and 34*d* are equalized. As a result, the normal force at each of the rollers 28 is identical. When sheet material is transported through the roller system 20 between the transport rollers and the idler rollers, no rotational movement is introduced as a result of uneven transport forces.

Although the present invention has been described with reference to specific embodiments, those of skill in the art will recognize that changes may be made thereto without departing from the scope and spirit of the invention as defined by the appended claims.

What is claimed is:

1. In an imaging system including a sheet material transport roller system having drive rollers and idler rollers, an idler roller assembly comprising the following:

a plurality of idler rollers;

a plurality of springs connected to apply respective normal forces to the idler rollers; and pivoting linkage means connecting said springs for equalizing the normal forces applied to the respective rollers by respective springs.

2. An idler roller assembly according to claim 1, wherein:

the plurality of idler rollers includes a first idler roller and a second idler roller;

the plurality of springs includes a first spring connected to apply a normal force to the first idler roller and a second spring connected to apply a normal force to the second idler roller; and the pivoting linkage means includes a first pivoting lever member connected between the first spring and the second spring.

3. An idler roller assembly according to claim 2, wherein the first pivoting lever member comprises the following:

a first end connected to the first spring member;

a second end connected to the second spring member; and a fulcrum point located between the first end and the second end of the first pivoting lever member.

4. An idler roller assembly according to claim 3, further comprising the following:

a first spring bracket connecting the first end of the first pivoting lever member to the first spring member; and a second spring bracket connecting the second end of the first pivoting lever member to the second spring member.

5. An idler roller assembly according to claim 1, wherein:

the plurality of idler rollers includes a first idler roller, a second idler roller, a third idler roller, and a fourth idler roller;

the plurality of springs includes a first spring connected to apply a normal force to the first idler roller, a second spring connected to apply a normal force to the second idler roller, a third spring connected to apply a normal force to the third idler roller, and a fourth spring connected to apply a normal force to the fourth idler roller; and the pivoting linkage means includes a first pivoting lever member connected between the first spring and the second spring, a second pivoting lever member connected between the third spring and the fourth spring, and a third pivoting lever member connected between the first pivoting lever member and the second pivoting lever member.

6. An idler roller assembly according to claim 5, wherein the first pivoting lever member comprises the following:

a first end connected to the first spring member;

a second end connected to the second spring member; and a fulcrum point located between the first end and the second end of the first pivoting lever member.

7. An idler roller assembly according to claim 6, wherein the second pivoting lever member comprises the following:

a first end connected to the third spring member;

a second end connected to the fourth spring member; and a fulcrum point located between the first end and the second end of the second pivoting lever member.

8. An idler roller assembly according to claim 7, wherein the third pivoting lever member comprises the following:

a first end connected to the fulcrum of the first pivoting lever member;

a second end connected to the fulcrum of the second pivoting lever member; and a fulcrum point located between the first end and the second end of the third pivoting lever member.

9. In an imaging system including a sheet material transport roller system having drive rollers and idler rollers, an idler roller assembly comprising the following:

a first idler roller;

a second idler roller;

a first spring connected to apply a normal force to the first idler roller;

a second spring connected to apply a normal force to the second idler roller; and a first pivoting lever member, connected between the first spring and the second spring, the first pivoting lever member being adapted and constructed to equalize the normal forces applied to the first and second rollers by the first and second springs.

10. An idler roller assembly according to claim 9, wherein the first pivoting lever member comprises the following:

a first end connected to the first spring member;

a second end connected to the second spring member; and a fulcrum point located between the first end and the second end of the first pivoting lever member.

11. An idler roller assembly according to claim 10, further comprising the following:

a first spring bracket connecting the first end of the first pivoting lever member to the first spring member; and a second spring bracket connecting the second end of the first pivoting lever member to the second spring member.

12. An idler roller assembly according to claim 9, further comprising the following:

a third idler roller;

a fourth idler roller;

a third spring connected to apply a normal force to the third idler roller;

a fourth spring connected to apply a normal force to the fourth idler roller;

a second pivoting lever member, connected between the third spring and the fourth spring, the second pivoting lever member being adapted and constructed to equalize the normal forces applied to the first and second rollers by the first and second springs.

13. An idler roller assembly according to claim 12, wherein the second pivoting lever member comprises the following:

a first end connected to the third spring member;

a second end connected to the fourth spring member; and a fulcrum point located between the first end and the second end of the second pivoting lever member.

14. An idler roller assembly according to claim 13, further comprising the following:

a third spring bracket connecting the first end of the second pivoting lever member to the third spring member; and a fourth spring bracket connecting the second end of the second pivoting lever member to the fourth spring member.

15. An idler roller assembly according to claim 12, further comprising a third pivoting lever member, connected between the first pivoting lever member and the second pivoting lever member, the third pivoting lever member being adapted and constructed to equalize the normal forces applied to the first, second, third and fourth rollers.

16. In an imaging system including a sheet material transport roller system having at least one pair of drive rollers and at least one pair of corresponding idler rollers, a method of reducing skew in sheet material transported by the roller system, the method comprising the following steps:

connecting a respective spring to each of the idler rollers in the at least one pair of idler rollers to apply respective normal forces to the idler rollers; and connecting a pivoting link between the springs connected the at least one pair of idler rollers to equalize the normal forces applied to the respective rollers by respective springs.

17. A method according to claim 16, wherein the step of connecting a pivoting link comprises connecting a pivoting lever member between the respective springs.

18. A method according to claim 17, wherein the at least one pair of drive rollers comprises a first pair of drive rollers and a second pair of drive rollers, and the at least one pair of corresponding idler rollers comprises a first pair of idler rollers and a second pair of idler rollers, and further wherein:

the step of connecting a respective spring to each of the idler rollers comprises connecting a spring to each of the idler rollers in the first pair of idler rollers and the second pair of idler rollers; and the step of connecting a pivoting link comprises connecting a first pivoting lever member between the springs connected to the first pair of idler rollers, and connecting a second pivoting lever member between the springs connected to the second pair of idler rollers.

19. A method according to claim 18, further comprising the step of connecting a pivoting link between the first pivoting lever member and the second pivoting lever member.

20. A method according to claim 19, wherein the step of connecting a pivoting link between the first pivoting lever member and the second pivoting lever member comprises connecting a third pivoting lever member between the first pivoting lever member and the second pivoting lever member.

* * * * *